US007717125B2

(12) United States Patent
Zheng

(10) Patent No.: US 7,717,125 B2
(45) Date of Patent: May 18, 2010

(54) COLLAPSIBLE PANEL ASSEMBLY

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 4 days.

(21) Appl. No.: 11/803,818

(22) Filed: May 16, 2007

(65) Prior Publication Data

US 2008/0283203 A1 Nov. 20, 2008

(51) Int. Cl.
*E04H 15/32* (2006.01)
*E04H 15/44* (2006.01)

(52) U.S. Cl. ..... 135/126; 135/120.3

(58) Field of Classification Search ..... 135/125–126, 135/128, 143, 144, 120.3; 446/108, 111, 446/112, 113, 116, 119, 120, 122
See application file for complete search history.

(56) References Cited

U.S. PATENT DOCUMENTS 5,038,812 A * 8/1991 Norman ..... 135/126
5,467,794 A * 11/1995 Zheng ..... 135/125
5,560,385 A * 10/1996 Zheng ..... 135/125
5,579,799 A 12/1996 Zheng
5,722,446 A 3/1998 Zheng
5,816,279 A 10/1998 Zheng
5,938,496 A * 8/1999 Zheng ..... 446/106
6,006,772 A 12/1999 Zheng
6,082,386 A 7/2000 Zheng
6,098,349 A 8/2000 Zheng
6,116,981 A 9/2000 Zheng
6,220,265 B1 * 4/2001 Zheng ..... 135/125
6,267,128 B1 7/2001 Zheng
6,305,396 B1 10/2001 Zheng
6,357,510 B1 3/2002 Zheng
6,446,918 B1 9/2002 Knight
6,453,923 B2 9/2002 Zheng
6,460,556 B2 10/2002 Zheng
6,568,981 B1 * 5/2003 Chang ..... 446/85
6,604,537 B2 8/2003 Zheng
6,668,847 B2 12/2003 Zheng
6,694,994 B1 2/2004 Zheng
6,698,441 B1 3/2004 Zheng
6,705,338 B2 3/2004 Zheng
6,758,003 B2 7/2004 Zheng
6,848,460 B2 2/2005 Zheng
6,856,504 B2 2/2005 Zheng
7,048,654 B2 5/2006 Zheng
7,073,523 B2 7/2006 Zheng
7,159,601 B2 1/2007 Zheng
7,252,106 B2 * 8/2007 Conforti ..... 135/117
2003/0141738 A1 7/2003 Straesser, Jr.
2005/0167428 A1 8/2005 Kollogg et al.
2006/0180284 A1 8/2006 Wiggins

* cited by examiner

*Primary Examiner*—David Dunn
*Assistant Examiner*—Danielle Jackson
(74) *Attorney, Agent, or Firm*—Raymond Sun

(57) ABSTRACT

An assembly includes a first panel and a second panel. Each panel has a foldable frame member having a folded and an unfolded orientation, with a fabric material covering selected portions of the respective frame member to form the respective panel when the respective frame member is in the unfolded orientation. A connection system is provided to removably connect the first and second panels.

10 Claims, 6 Drawing Sheets

COLLAPSIBLE PANEL ASSEMBLY

BACKGROUND OF THE INVENTION

1. Field of the Invention

The present invention relates to collapsible structures, and in particular, to a system for assembling or otherwise building objects from separate collapsible panels using connectors.

2. Description of the Prior Art

Collapsible structures have recently become popular with both adults and children alike. Examples of such structures are shown and described in U.S. Pat. Nos. 5,038,812 (Norman), 5,467,794 (Zheng) and 5,560,385 (Zheng). These structures have a plurality of panels that may be twisted and folded to reduce the overall size of the structures to facilitate convenient storage and use. As such, these structures are being enjoyed by many people in many different applications.

Most of these collapsible structures are pre-assembled with the panels connected to adjacent panels by stitching or other non-detachable connections. Therefore, it is not possible to change the configuration of the structure, so the variety of use and play for these structures can be limited.

Thus, there still remains a need for collapsible structures that provide increased variety of play, entertainment value, and utility.

SUMMARY OF THE DISCLOSURE

In order to accomplish the objects of the present invention, the present invention provides an assembly that includes a first panel and a second panel. Each panel has a foldable frame member having a folded and an unfolded orientation, with a fabric material covering selected portions of the respective frame member to form the respective panel when the respective frame member is in the unfolded orientation. A connection system is provided to removably connect the first and second panels.

In one embodiment, the connection system includes a flexible connector that is made of a different material than the frame members and the fabric material, with the flexible connector removably connecting the first and second panels.

In another embodiment, the connection system includes a first connector piece that is provided on the first panel and a second connector piece that is provided on the second panel, with the connector pieces removably connected to each other to removably connect the first and second panels.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are configured in the form of one or more collapsible panels that are connected to each other by connectors. These structures can be folded and collapsed into a compact configuration for convenient storage and transportation.

Figure 1:
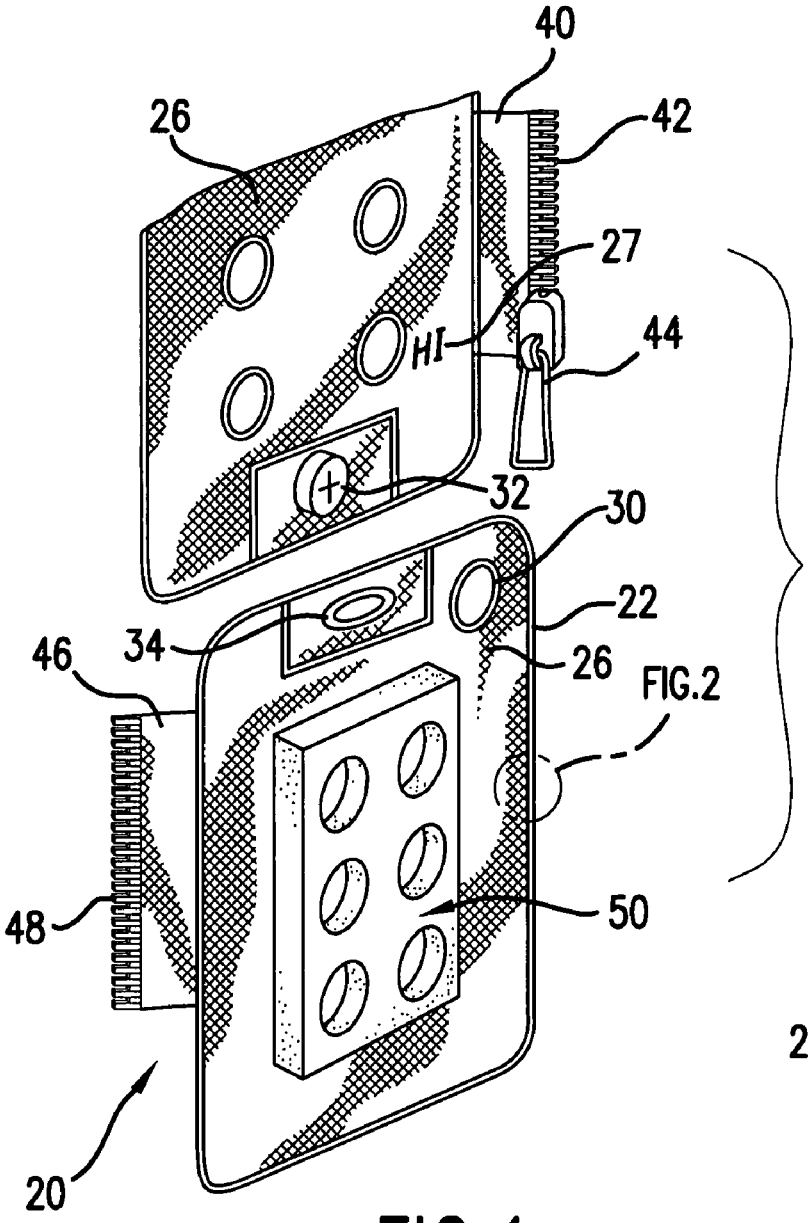
FIG. 1 is a perspective view of a collapsible panel according to the present invention.

FIG. 1 illustrates a basic embodiment for a collapsible panel 20. As explained in greater detail hereinbelow, the collapsible structures according to the present invention can each be comprised of one or more of these panels 20 assembled to create a resulting structure having the desired shape and size.

Figure 2:
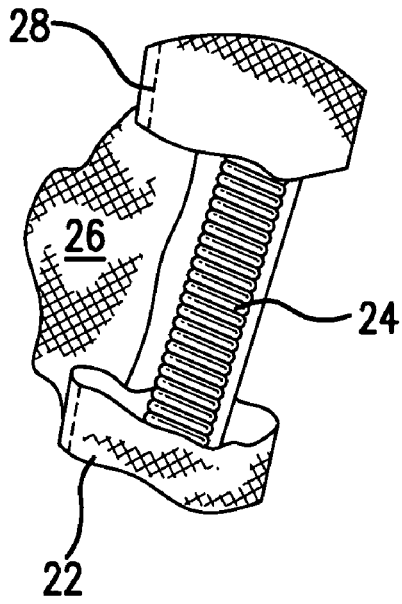
FIG. 2 is a partial cut-away view of the section 2 of the structure of FIG. 1 illustrating a frame member retained within a sleeve.

Referring to FIG. 1, the panel 20 is shown as having four sides, although it can have any number of sides and assume any desired size or shape. A continuous frame retaining sleeve 22 is provided along and traverses the periphery of the panel 20. As shown in FIG. 2, a frame member 24 is retained or held within the frame retaining sleeve 22 to support the panel 20. The frame member 24 may be provided as one continuous loop, or may comprise a strip of material connected at both ends to form a continuous loop, or a strip of material having both ends unconnected but retained within the sleeve 22. The frame member 24 is preferably formed of flexible coilable steel having a memory, although other materials such as plastics may also be used. The frame member 24 should be made of a material which is relatively strong and yet is flexible to a sufficient degree to allow it to be coiled. Thus, the frame member 24 is capable of assuming two positions or orientations, an open or expanded position such as shown in FIG. 1, or a folded position in which the frame member 24 is collapsed into a size which is much smaller than its open position (see FIG. 3E).

A fabric or sheet material 26 can be provided to extend across the panel 20, and is held taut by the frame member 24 when in its open position. Fabric 26 can extend completely across the panel 20 to entirely cover the enclosed space defined by the frame member 24, or can extend across selected portions of the enclosed space defined by the frame member 24. The term fabric is to be given its broadest meaning and should be made from strong, lightweight materials and may include woven fabrics, sheet fabrics or even films. The fabric 26 should be water-resistant and durable to withstand wear and tear. The type of material used for the fabric 26 can be varied depending on the intended use.

Referring to FIG. 2, the fabric piece 26 is stitched at its edges by a stitching 28 to the sleeve 22. The sleeve 22 may be formed by folding a piece of fabric, and then applying the stitching 28 to connect the sleeve 22 to the fabric 26. Alternatively, the frame retaining sleeve 22 may be formed by merely folding over the fabric 26 and applying the stitching 28. The frame member 24 may be merely retained within the frame retaining sleeve 22 without being connected thereto. Alternatively, the frame retaining sleeve 22 may be mechanically fastened, stitched, fused, or glued to the frame member 24 to retain it in position.

Amusement features can be provided on the panel 20 of FIG. 1. For example, these amusement features can include indicia 27 such as a message, logo, or design that can be imprinted or otherwise provided on one or both sides of the fabric 26, at any location thereon. Other amusement features, as illustrated in the other embodiments herein, can also be incorporated and provided on the panel 20.

Figure 3A:
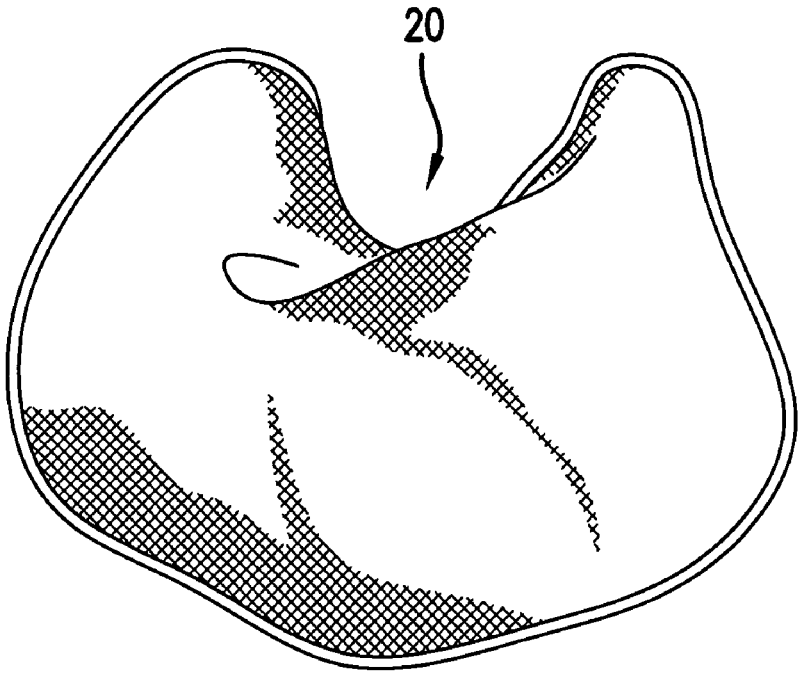
FIGS. 3A through 3E illustrate how the collapsible panel of FIG. 1 may be twisted and folded for compact storage.
Figure 3B:
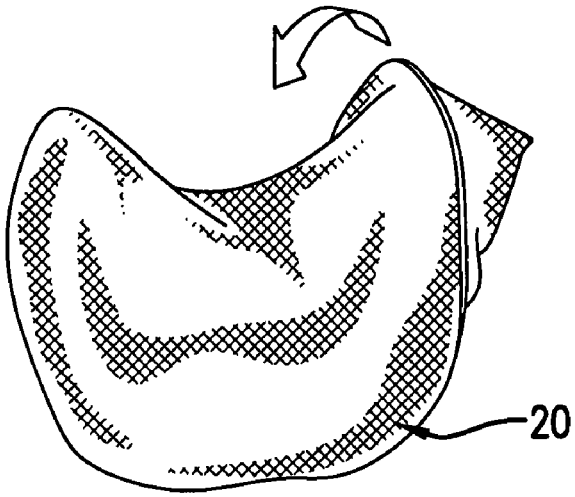
Figure 3C:
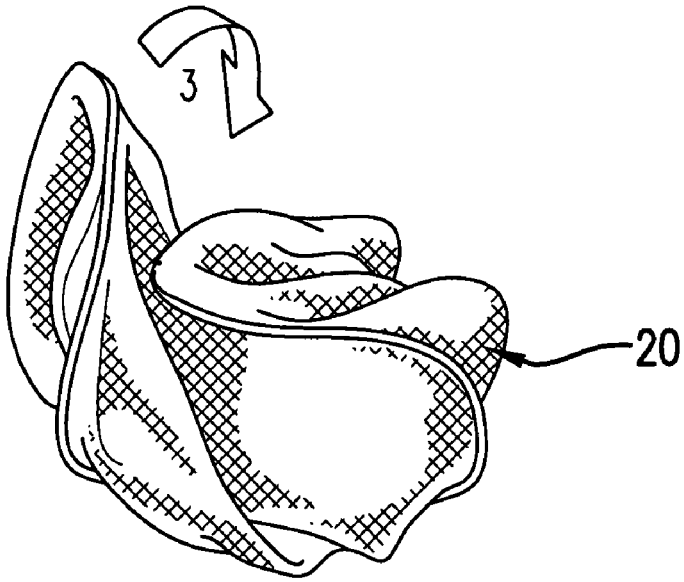
Figure 3D:
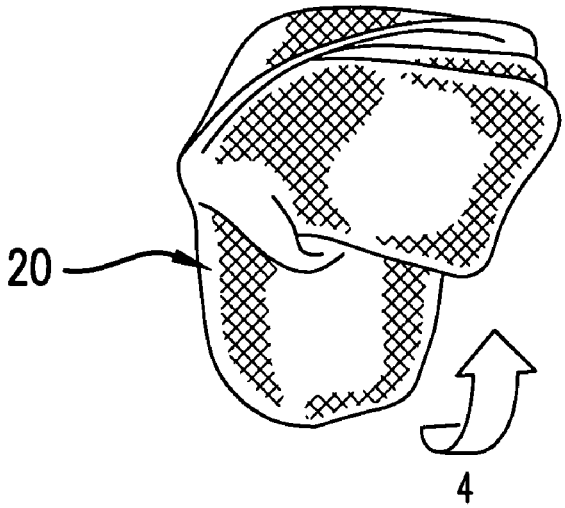
Figure 3E:
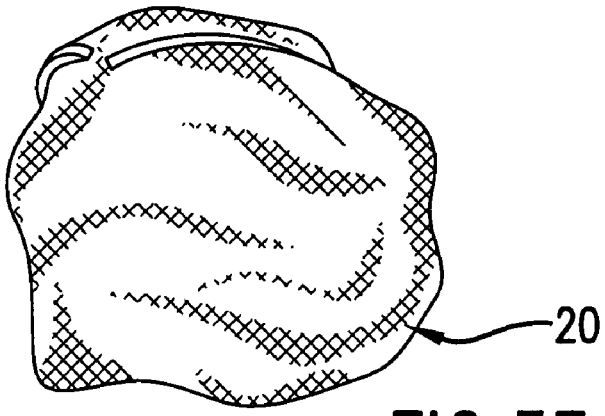

FIGS. 3A-3E describe the various steps for folding and collapsing the panel 20 of FIG. 1 for storage. In FIG. 3A, the first step consists of folding in the opposite borders of the panel 20. As shown in FIGS. 3B-3D, the borders are folded in upon the previous fold to further collapse the frame member 24 with the panel 20 so that the initial size of the panel 20 is reduced. FIG. 3E shows the frame member 24 and panel 20 collapsed on each other to provide for a small essentially compact configuration having a plurality of concentric frame members 24 and layers of the fabric 26 so that the collapsed panel has a size which is a fraction of the size of the initial panel 20.

Each basic panel 20 can be used as a building block and combined with other basic panels to provide structures having different shapes and sizes, as illustrated below. The present invention discloses different connection systems that can be used for connecting panels 20.

FIG. 1 illustrates two connection systems according to the present invention. The first connection system comprises a button and hole combination where a button 32 is provided on the fabric 26 of one panel, and a button hole 34 is provided on the fabric 26 of another panel 20, so that the button 32 can be inserted through the button hole 34 to effectuate the connection of the two panels 20 at the location of the button hole 34. These buttons 32 and button holes 34 can be provided anywhere on the fabric 26 to facilitate connection at different locations, such as along the edge of the panel 20, or in the middle of the panel 20. The button connection allows the two connected panels 20 to be pivoted with respect to each other about the button 32 acting as a pivot point.

The second connection system comprises a zipper system where one panel has a connecting fabric 40 that has one edge stitched to an edge of the panel, and with its other edge having a zipper edge 42, and a zipper 44 provided to travel along the zipper edge 42. The other panel 20 can have a connecting fabric 46 that has one edge stitched to an edge of the panel 20, and with its other edge having a zipper edge 48. The panels can be connected by pulling the zipper 44 along the zipper edges 42, 48 to connect the panels at the location of the connecting fabrics 40, 46. These connecting fabrics 40, 46 can be provided anywhere on the fabric 26 to facilitate connection at different locations, such as along an edge of the panel 20, or even in the middle of the panel 20.

FIGS. 1 and 4-6 illustrate yet another connection system that can be used to connect a panel 20 to another panel 20. First, connection holes or openings 30 can be provided in the fabric 26 and used in the manner to connect the panel 20 with a selected support piece 50. These openings 30 can be provided anywhere on the fabric 26 to facilitate connection at different locations, such as along the edge of the panel 20, or in the middle of the panel 20.

Figure 4:
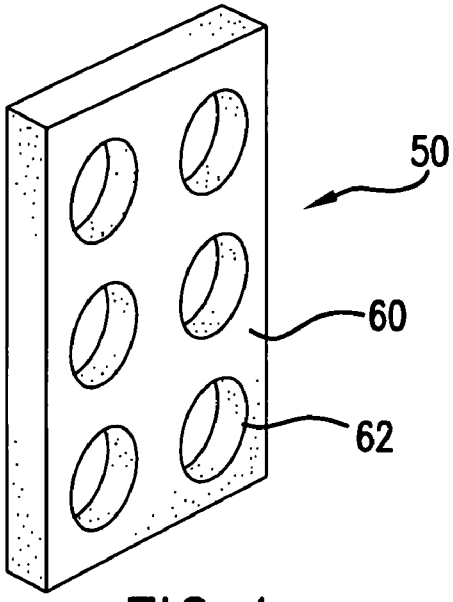
FIG. 4 is a perspective view of a support piece for a connector system according to one embodiment of the present invention.
Figure 5:
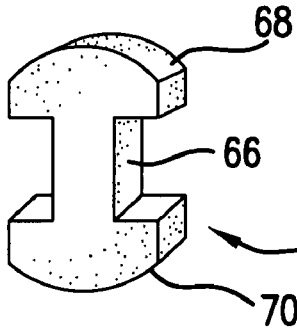
FIGS. 5 and 6 are perspective views of connectors for a connector system according to the present invention.
Figure 6:
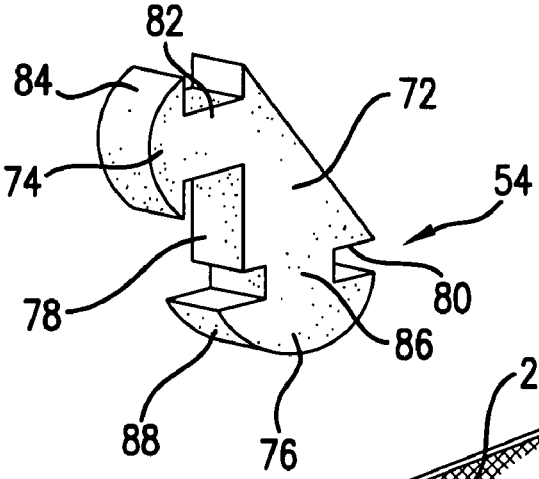

The connection system further includes support pieces and connectors. An example of a support piece 50 is shown in FIG. 4, and examples of connectors 52 and 54 are shown in FIGS. 5 and 6, respectively. As explained in greater detail below, the support piece 50 can also be an interconnecting piece to interconnect two or more panels. Other examples of connectors and support pieces are illustrated in U.S. Pat. No. 6,116,981, whose entire disclosure is hereby incorporated by this reference as though set forth fully herein.

Each connector 52, 54 and support piece 50 can be made from a material that is soft and flexible to allow it to be bent, folded or otherwise deformed, yet strong enough to allow the connections created from connections of such pieces to have structural stability. Examples of such materials include but are not limited to foam, polyethylene, polyurethane and PVC (expanded foam).

Referring to FIG. 4, the support piece 50 has a substantially rectangular body 60, although the body 60 can be in any shape or size. The thickness of the body 60 is preferably consistent throughout. A plurality of apertures 62 are cut out or otherwise provided in the body 60, and can be located at any location of the body 60. In FIG. 4, the apertures 62 are shown as being provided in rows and columns so that any of these apertures 62 can be utilized for a connection. As shown in FIG. 1, the support piece 50 can be stitched, glued or otherwise secured to the panel 20. Even though FIG. 1 illustrates the support piece 50 as being secured to the fabric 26, it can be secured at any location on the panel 20.

Referring to FIG. 5, the connector 52 is adapted for use in connecting two panels 20 in a parallel manner. The connector 52 has an I-shaped body with a shaft 66 that has two deformable sections at opposite ends of the shaft 66. Each deformable section is essentially comprised of ears 68, 70 that extend perpendicular to the shaft 66. Again, the thickness of the body is preferably consistent throughout.

Referring to FIG. 6, the connector 54 is adapted for use in connecting two panels 20 in a perpendicular manner. The connector 54 has a triangular-shaped body 72 with two generally T-shaped deformable sections 74 and 76 extending from adjacent right-angled edges 78 and 80, respectively, of the body 72. The thickness of the body 72 and sections 74, 76 are preferably consistent throughout. The deformable section 74 has a shaft 82 that extends from the edge 78, with two ears 84 extending perpendicular to the shaft 82 at an end the shaft 82. Similarly, the deformable section 76 has a shaft 86 that extends from the edge 80, with two ears 88 extending perpendicular to the shaft 86 at an end the shaft 86.

The diameter of the apertures 62 should be about the same as the diameter of the openings 30, and these openings 30 and apertures 62, as well as the widths of the shafts 66, 82 and 86, should be sized and configured to allow the shafts 66, 82, 86 to extend through any of the openings 30 and apertures 62. Also, the ears 68, 70, 84 and 88 should be sized and configured so that they can be bent or deformed to allow them to be squeezed through the openings 30 and apertures 62.

Figure 7:
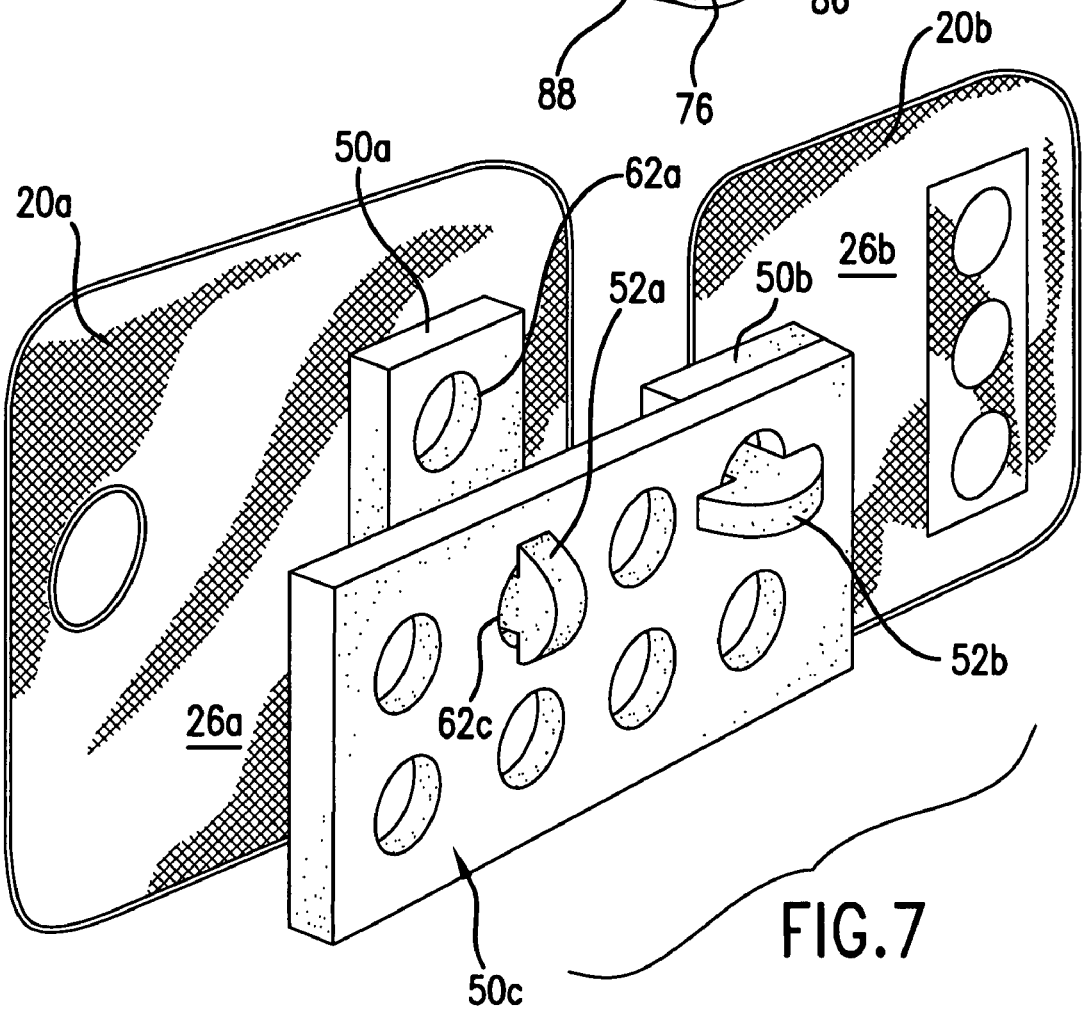
FIGS. 7 and 8 illustrate how the connection system of FIGS. 4-6 can be used to connect two panels.
Figure 8:
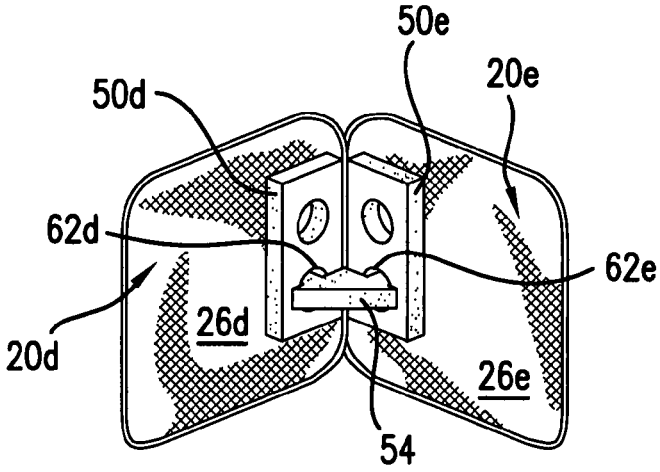

FIGS. 7 and 8 illustrate how the connection system of FIGS. 4-6 can be used to connect two panels. FIG. 7 illustrates two panels 20*a* and 20*b*, each of which can have the same general construction as the panel 20 but with a different size and/or shape. A supporting piece 50*a* can be secured to the panel 20*a* at the location of a selected aperture 62*a* and opening (not shown) on the panel 20*a*, and another supporting piece 50*b* can be secured to the panel 20*b*. The pieces 50*a*, 50*b* can have the same general construction as the piece 50 but with a different size and/or shape. Another supporting piece 50*c* can be utilized as an interconnecting piece, with one connector 52*a* inserted through a selected aperture 62*c* in the piece 50*c*, another aperture 62*a* in the piece 50*a*, and the opening in the fabric 26*a* of the panel 20*a*. Similarly, another connector 52*b* is inserted through another selected aperture 62*c* in the piece 50*c*, another aperture 62*b* in the piece 50*b*, and the opening in the fabric 26*b* of the panel 20*b*. Thus, the interconnecting piece 50*c* functions to connect the panels 20*a* and 20*b* in a side-by-side manner along the same plane.

FIG. 8 illustrates two panels 20*d* and 20*e*, each of which can have the same general construction as the panel 20 but with a different size and/or shape. A supporting piece 50*d* can be secured to the panel 20*d* at the location of a selected aperture 62*d* and opening (not shown) on the panel 20*d*, and another supporting piece 50*e* can be secured to the panel 20*e* at the location of a selected aperture 62*e* and opening (not shown) on the panel 20*e*. The pieces 50*d*, 50*e* can have the same general construction as the piece 50 but with a different size and/or shape. A connector 54 is used to connect the panels 20*d*, 20*e* at an orientation that is perpendicular to each other, with the shaft 82 and ears 84 inserted through a selected aperture 62*e* in the piece 50*e* and the opening in the fabric 26*e* of the panel 20*e*. Similarly, the shaft 86 and ears 88 can be inserted through a selected aperture 62*d* in the piece 50*d* and the opening in the fabric 26*d* of the panel 20*d*.

Figure 9:
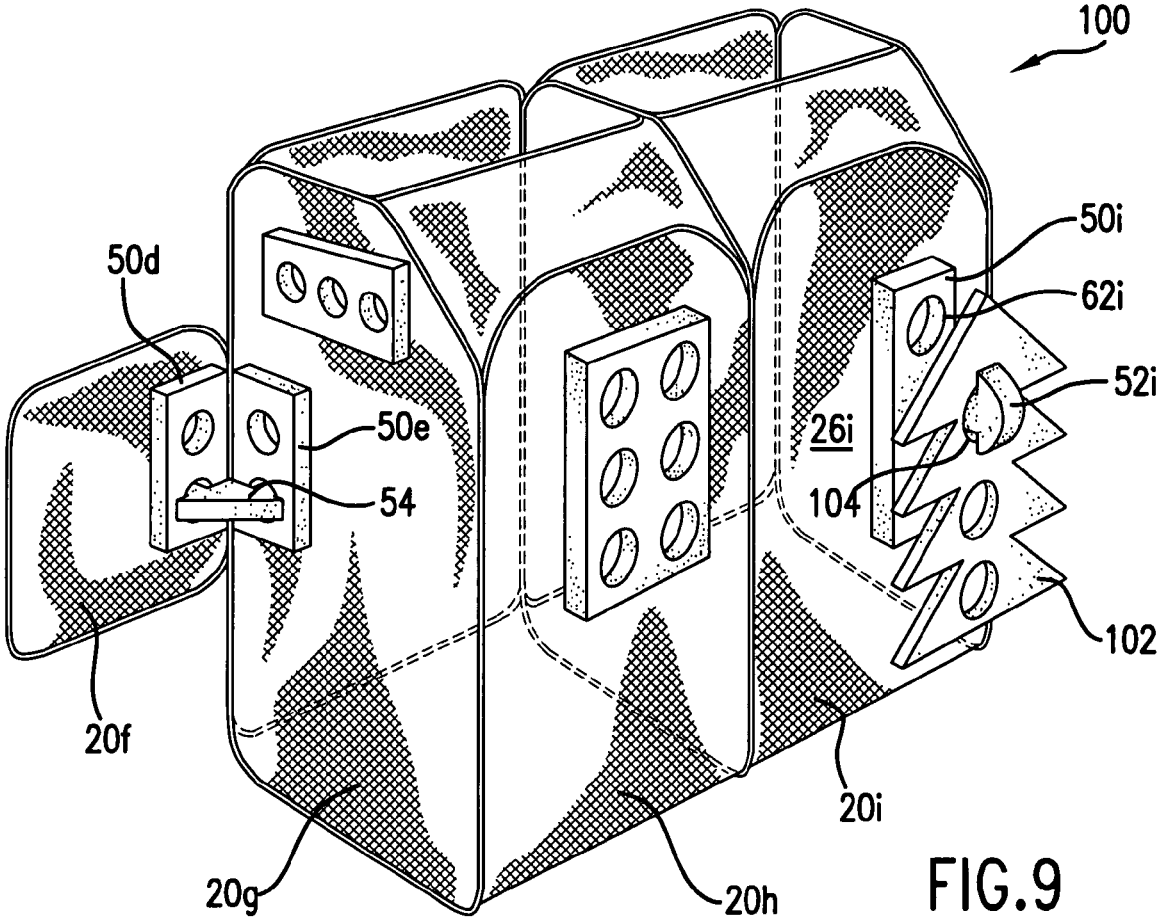
FIGS. 9-10 illustrate how the connection system of FIGS. 4-6 can be used with structures that are made up of a plurality of collapsible panels.

FIG. 9 further illustrates how the connection system of FIGS. 4-6 can be used with structures that are made up of a plurality of collapsible panels. The structure 100 shown in FIG. 9 is comprised of a plurality of panels (e.g., 20*g*, 20*h*, 20*i*, among others) that are hingedly connected to each other in the manner described in U.S. Pat. No. 6,390,111 to form an enclosed space. The entire disclosure of U.S. Pat. No. 6,390,111 is hereby incorporated by this reference as though set forth fully herein. Another panel 20*f* can be connected to the panel 20*g* using the connection illustrated in FIG. 8 using supporting pieces 50*d*, 50*e* and a connector 54. In addition, an ornament 102 (such as a Christmas tree) that is made of a similar material as the connectors 52, 54 and the supporting piece 50 can be removably attached to the panel 20*i* via a supporting piece 50*i* and a connector 52*i* that can have the same construction as the piece 50 and the connector 52, respectively. The shaft 66 and the ears 68 of the connector 52*i* can be inserted through an aperture 104 in the ornament 102, through a selected aperture 62*i* on the piece 50*i*, and through an opening (not shown) in the fabric 26*i* of the panel 20*i*.

Figure 10:
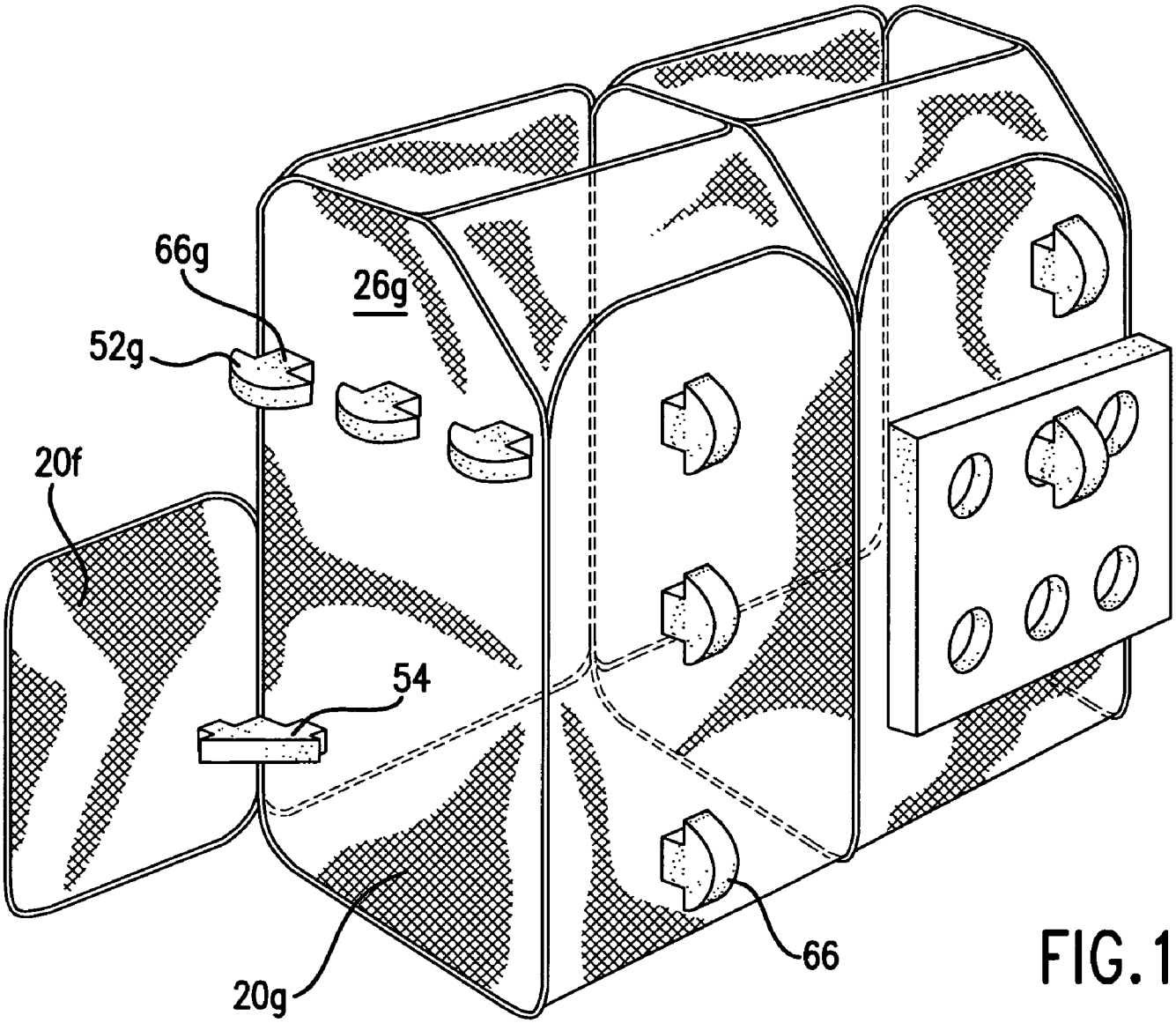

FIG. 10 illustrates modifications that can be made to the structure 100 of FIG. 9. For example, the connector 54 alone can be used to connect the panels 20*f* and 20*g*, thereby omitting the supporting pieces 50*d* and 50*e*. In addition, other supporting pieces can be omitted so that only connectors (e.g., 52*g*) are used without the supporting pieces. As a further alternative, these connectors 52*g* can be fixedly attached to specific locations on any of the panels. For example, the connector 52*g* can be shaped as half the connector 52 in FIG. 5 and attached (e.g., by glue, fusing, stitching) at the shaft 66*g* to the fabric 26*g* of the panel 20*g*.

Thus, the present invention provides a system and method whereby a user can take a plurality of panels 20, and through the use of any of the connection systems described above, can assemble a wide variety of different structures and objects. These panels 20 and connection systems form the basic building blocks for building a wide variety of objects. In addition, many of these connection systems are separate and removable so that the user can change the construction, shape and size of the object, and use the connection systems to add ornaments and other components and items.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An assembly comprising:

a first panel and a second panel, each panel having a foldable frame member having a folded and an unfolded orientation, with a fabric material covering selected portions of the respective frame member to form the respective panel when the respective frame member is in the unfolded orientation;

a first supporting piece fixedly attached to the first panel;

a second supporting piece fixedly attached to the second panel;

a third supporting piece;

a flexible connector removably connecting the first and second supporting pieces; and wherein the connector, and the first, second and third supporting pieces are made of a different material than the fabric material;

wherein the connector, and the first, second and third supporting pieces are made of the same material; and wherein an opening is provided in the fabric material of each of the first and second panels, and wherein each of the first and second supporting piece has an opening that is aligned with a corresponding opening of the first and second panel, respectively, and with the connector extended through the respective pair of openings in the first and second panels and the first and second supporting pieces to connect the first and second panels.

2. The assembly of claim 1, wherein the connector has a shaft and a deformable section extending from a portion of the shaft, the deformable section being deformed to insert the connector through the openings in the supporting pieces and the panels.

3. The assembly of claim 2, wherein the deformable section has a width that is greater than the width of the openings in the supporting pieces and the panels.

4. The assembly of claim 1, wherein the connector connects the first and second panels in a manner where the first and second panels are parallel to each other.

5. The assembly of claim 1, wherein the connector connects the first and second panels in a manner where the first and second panels are perpendicular to each other.

6. The assembly of claim 1, wherein each frame member is twisted and folded to form a plurality of concentric frame members when in the folded orientation.

7. An assembly comprising:

a panel having a foldable frame member having a folded and an unfolded orientation, with a fabric material covering selected portions of the frame member to form the panel when the frame member is in the unfolded orientation;

a first supporting piece fixedly attached to the panel;

a second supporting piece;

a flexible connector removably connecting the first and second supporting pieces; and wherein the connector, and the first and second supporting pieces are made of a different material than the fabric material;

wherein the connector, and the first and second supporting pieces are made of the same material; and wherein an opening is provided in the fabric material of the panel, and wherein each of the first and second supporting piece has an opening, with the opening of the first supporting piece aligned with the opening of the panel, and with the connector extended through the respective openings in the panel and the first and second supporting pieces to connect the panel and the second supporting piece.

8. The assembly of claim 7, wherein the connector has a shaft and a deformable section extending from a portion of the shaft, the deformable section being deformed to insert the connector through the openings in the supporting pieces and the panel.

9. The assembly of claim 8, wherein the deformable section has a width that is greater than the width of the openings in the supporting pieces and the panel.

10. The assembly of claim 7, wherein each frame member is twisted and folded to form a plurality of concentric frame members when in the folded orientation.

* * * * *